US005234290A

United States Patent [19]

Collins

[11] Patent Number: 5,234,290

[45] Date of Patent: Aug. 10, 1993

[54] PRESTRESSED CAISSON BEARING PIER AND STRUCTURAL FOUNDATION DEVICE

[75] Inventor: James S. Collins, Marietta, Ohio

[73] Assignee: Rodney B. Stewart, Belpre, Ohio

[21] Appl. No.: 787,050

[22] Filed: Nov. 4, 1991

[51] Int. Cl.[5] ..... E02D 7/00; E02D 5/00

[52] U.S. Cl. ..... 405/249; 405/231; 405/232; 405/233; 52/292

[58] Field of Search ..... 405/229, 231–233, 405/237, 238, 244, 249; 52/160–162, 169.9, 294–296, 292

[56] References Cited

U.S. PATENT DOCUMENTS

| | | | |
|---|---|---|---|
| 81,682 | 9/1868 | Porter | 405/231 |
| 2,678,540 | 5/1954 | Lorenz | 405/249 |
| 3,570,258 | 3/1971 | Fuller | 405/233 |
| 3,630,037 | 12/1971 | Howard . | |
| 3,685,301 | 8/1972 | Heacox . | |
| 4,225,269 | 9/1980 | Matsui | 405/231 X |
| 4,591,466 | 5/1986 | Murray et al. | 264/35 |
| 4,603,520 | 8/1988 | Deike | 52/160 X |
| 4,721,418 | 1/1988 | Queen | 405/231 |
| 4,843,785 | 7/1989 | Sero et al. | 52/160 |
| 4,882,891 | 11/1989 | Sero et al. | 52/742 |
| 4,974,997 | 12/1990 | Sero et al. | 405/231 |

FOREIGN PATENT DOCUMENTS

| | | | |
|---|---|---|---|
| 265573 | 8/1912 | Fed. Rep. of Germany | 405/229 |
| 1129895 | 5/1962 | Fed. Rep. of Germany | 405/233 |
| 3835296 | 3/1989 | Fed. Rep. of Germany | 405/244 |
| 2519045 | 7/1983 | France | 405/232 |
| 667636 | 6/1979 | U.S.S.R. | 405/232 |

OTHER PUBLICATIONS

B. K. Hough, *Basic Soils Engineering*, Chaper 11, pp. 316–351.

B. K. Hough, *Basic Soils Engineering*, Chapter 14, pp. 390–417.

B. K. Hough, *Basic Soils Engineering*, Chapter 5, pp. 97–134.

B. K. Hough, *Basic Soils Engineering*, Chapter 6, pp. 135–167.

B. K. Hough, *Basic Soils Engineering*, Chapter 10, pp. 271–315.

*Primary Examiner*—Dennis L. Taylor
*Assistant Examiner*—John A. Ricci
*Attorney, Agent, or Firm*—Webb, Burden, Ziesenheim & Webb

[57] ABSTRACT

A bearing pier foundation for compacting soil that includes a plug extending along the longitudinal axis having a first section and a second section. The first section adapted to receive a pushing force for pushing the plug into the soil and the second section adapted to rest on the soil to be compacted. A plane, which is perpendicular to the longitudinal axis, passes through the second section. The second section includes a first part and a second part. The first part has an inner edge and an outer edge intersecting the plane. The outer edge of the first part attaches to the first section and is positioned further away from the longitudinal axis than the inner edge of the first part. The second part has an outer edge attached to the first part inner edge. The second part extends downwardly from the plane and the second part has a tapering segment extending along the longitudinal axis and includes an upper end and a lower end. The upper end is positioned closer to the plane and has a larger geometric diameter than the lower end. The segment continuously tapers from the upper end to the lower end. The bearing pier foundation can be used in connection with a sheath which conforms to the outer surface of the bearing pier foundation. Further, the bearing pier foundation can be used in combination with a hydraulic setting tool. Also, disclosed is a method for installing the plug and sheath into the soil to compress and consolidate the soil thereunder.

36 Claims, 10 Drawing Sheets

PRESTRESSED CAISSON BEARING PIER AND STRUCTURAL FOUNDATION DEVICE

BACKGROUND OF THE INVENTION

1. Field of the Invention

This invention relates to soil compacting methods and devices and, more particularly, to a method and a device for increasing the bearing capacity of soil.

2. Description of the Prior Art

Structural foundations are designed to transmit the weight of the structure to the underlying soil or rock, which serves as a basic supporting member. The foundation must be essentially unyielding, since one of the chief requirements is the minimization or the elimination of settlement due to yielding of the soil under applied loads.

Structural foundations are of two main types, namely, spread foundations and pilings.

A spread foundation is a structural element designed to distribute a concentrated load to reduce the distributed pressure to an allowable use which can safely be supported by the soil thereunder.

When the soil at or below the level where the spread foundation would normally be placed is unsuitable in some respect for a spread-foundation design, then the weight of the structure must in some manner be transferred to the soil at greater depths or to rock. Bearing piles or caissons are used for this purpose. Such piles can be friction piles, which are supported through skin friction, Gow caisson piles or end bearing piles, which rely on the firmness and strength of hard soil or rock below the surface of the soil.

Spread foundations are preferable because they are relatively inexpensive compared to piles.

However, when the safe bearing capacity or bearing value of the soil is less than the pressure applied to the soil by the foundation, then the foundation must be made of piles unless the soil can be stabilized. The most popular way to stabilize the soil is through compaction by vibrating devices or rollers. Further, by compacting the soil consolidation occurs, which is the removal of any excess water contained therein.

Present methods of compacting loose grain soil can increase the load-bearing capacity of the soil substantially. However, under the present systems, compacting soil requires extensive amounts of machinery and a considerable amount of time. The same is true for pile foundations. Also, these methods only compact the soil in the vertical direction and very little compaction or strength is achieved in the lateral direction. Further, under present systems, determining the load-bearing capacity of compacted soil is very difficult and time consuming at best.

Therefore, it is an object of our invention to compact soil quickly and inexpensively.

Further, it is an object of our invention to compact soil with a minimum amount of equipment.

It is another object of the invention to compact soil in both the lateral direction and vertical direction whereby prestressing the soil prior to submitting the soil to bearing loads and to accurately determine load-bearing capacity of the soil.

SUMMARY OF THE INVENTION

My invention is a bearing pier foundation for compacting soil having a plug extending along a longitudinal axis. The plug includes a first section and a second section, where the first section is adapted to receive a pushing force for pushing the plug into the soil and the second section is adapted to rest on the soil to be compacted. The first section can be of many shapes such as circular or polygonal, such as triangular, square or rectangular. A geometric plane, which is perpendicular to the longitudinal axis, passes through the second section. The second section includes a first part and a second part. The first part has an inner edge and an outer edge intersecting the plane. The outer edge of the first part attaches to the first section and is positioned further away from the longitudinal axis than the inner edge of the first part. Preferably, the first part forms a recess positioned above the plane. The second part has an outer edge attached to the first part inner edge. The second part extends downwardly from the plane and has a tapering segment extending along the longitudinal axis and has an upper end and a lower end. The upper end is positioned closer to the plane than the lower end and has a larger geometric diameter than the lower end. Preferably, the lower end is positioned below the first segment. The segment continuously tapers from the upper end to the lower end.

The plug can further include a tube attached to the second section and coaxial with and extending along the longitudinal axis. The lower end of the tube is positioned below the plane and the second part. The first section can also include a flat upper surface with a hole coaxial with the longitudinal axis with the hole disposed above the tube lower end so that the tube passes through the hole and an upper end of the tube is flush with the upper surface.

The bearing pier second section can be many shapes. For example, the second section can include a first frusto pyramid shaped surface having a first end which is larger than the second end and a second frusto pyramid shaped surface having a third end which is larger than the fourth end. The second end and third end being substantially the same size whereby the second end attaches to the third end and the first end attaches to the first section. The fourth end is positioned below the first end. The second end and third end are positioned above the plane. The fourth end is positioned below the plane.

Also, the bearing pier second section can include a first frusto cone shaped surface having a first end larger than the second end and a second frusto cone shaped surface having a third end which is larger than a fourth end. The second end and third ends are the same size whereby the second end attaches to the third end. The first end attaches to the first section and the fourth end is positioned below the first end. The second end and the third end are positioned above the plane. The fourth end is positioned below the plane.

A further embodiment of my invention is to provide a sheath for the bearing pier whereby the sheath includes a first section having an inner surface conforming to a side surface of a plug first section and an integral second section have an inner surface conforming to the outer surface of the second section of the plug. The inner surfaces of the sheath form a cavity adapted to receive the plug. The sheath further includes an integral open-ended tube attached to and extending below the sheath second section The tube can have an inner diameter approximately equal to the outer diameter of the plug tube. Preferably the sheath is made of plastic material.

Further, the bearing pier can be used in combination with an extendable hydraulic setting tool. The hydraulic setting tool includes a device for applying compressing force to the first section of the plug and thereby forces the plug second section into the soil and includes an anchor.

Further, the invention also includes a method for making a soil foundation utilizing the bearing plug for compacting soil. The method includes the steps of placing the second section of the plug on the surface of uncompressed soil; applying a compressing force to the first section and then forcing the plug into the soil, thereby compressing and consolidating the soil directly below the plug. The method can further include embedding the plug in concrete after the soil is compressed and consolidated. The method can also include placing the sheath over the plug before compressing the soil and then removing the plug from the compressed and consolidated soil leaving the sheath in the soil and embedding the sheath in concrete. Also, the method can include digging a hole in the soil and placing the plug over the hole, placing the anchor into the hole and engaging the anchor with the soil, and activating the setting tool to apply the compressing force of the plug.

Furthermore, the method can include utilizing a gauge with the setting tool for measuring the hydraulic fluid pressure of the hydraulic fluid in the cylinders and measuring the fluid pressure of the hydraulic cylinder while the plug is being forced into the soil.

DESCRIPTION OF THE PREFERRED EMBODIMENTS

Figure 1:
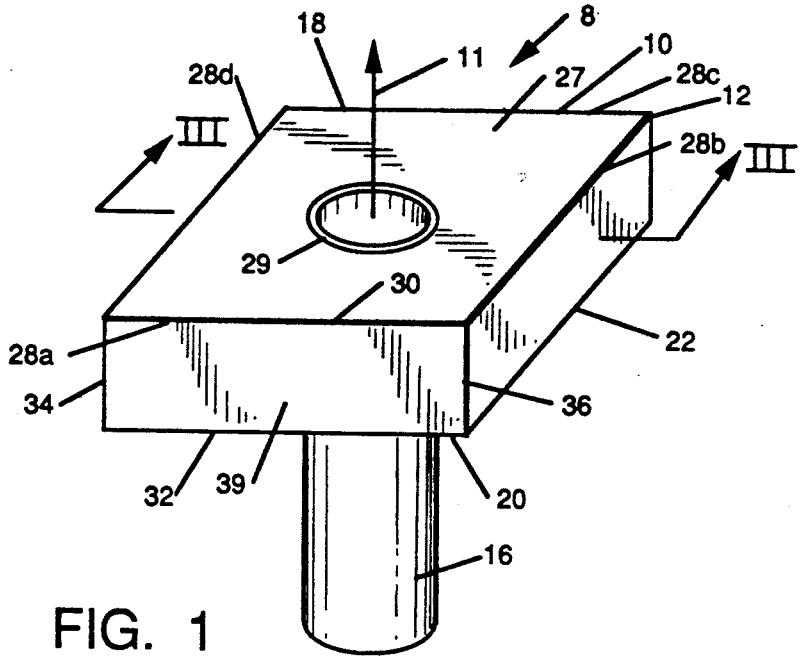
FIG. 1 is a top perspective view of a bearing pier foundation in accordance with the present invention.
Figure 2:
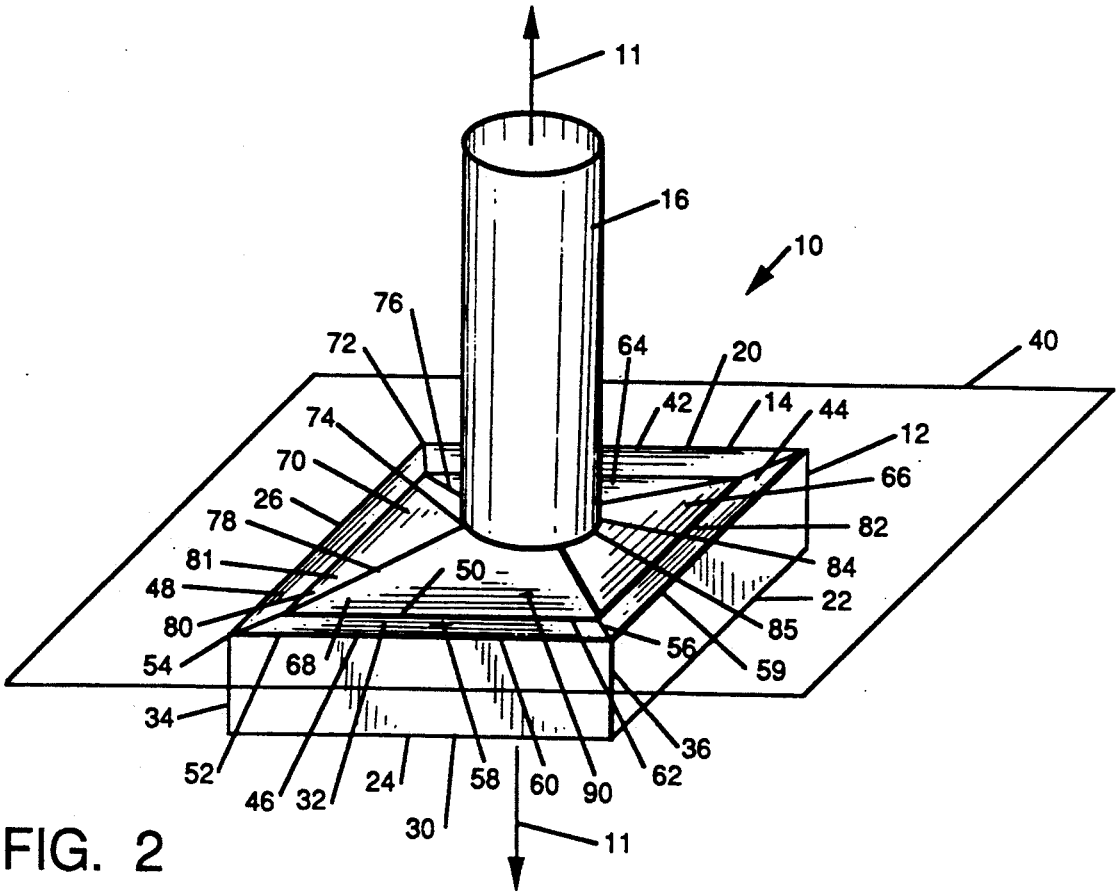
FIG. 2 is a bottom perspective view of the bearing pier shown in FIG. 1.
Figure 3:
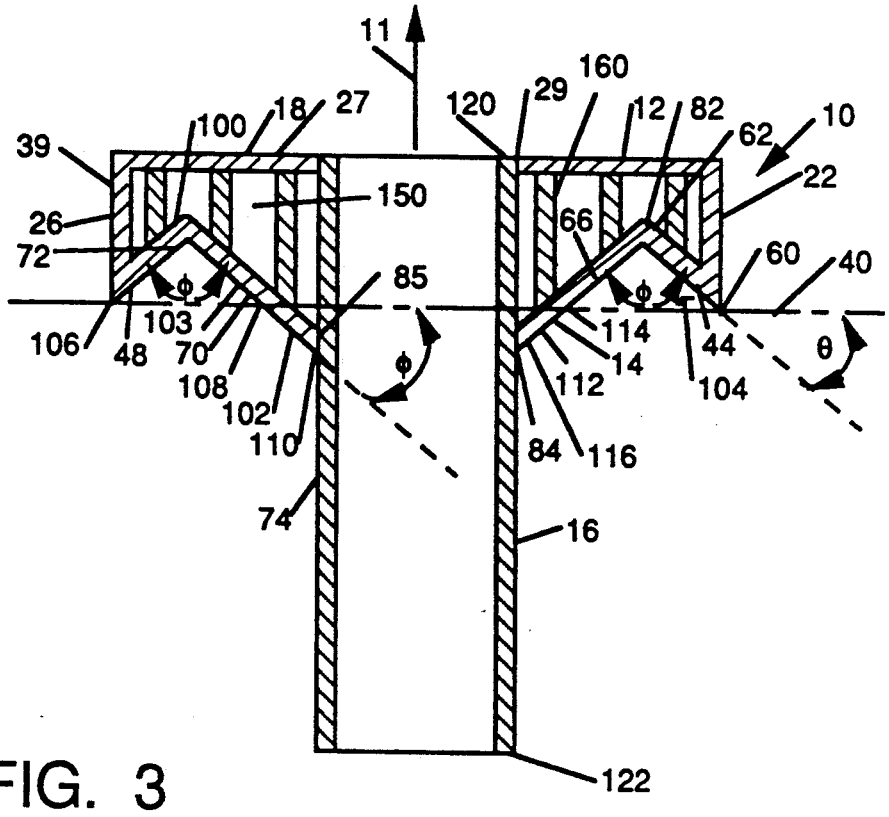
FIG. 3 is a section taken along lines III—III in FIG. 1.

FIGS. 1-3 show a bearing pier foundation 8 having a plug 10 made in accordance with the present invention. The plug 10 extends along a longitudinal axis 11 and includes a first section 12 attached to a second section 14 and a tube 16 that extends below the second section 14. The tube 16 is coaxial with longitudinal axis 11 and attaches to either the first section 12 or the second section 14.

The first section 12 includes an upper wall 18 and four side walls 20, 22, 24 and 26 attached to and depending therefrom. Upper wall 18 includes a substantially flat, square shaped upper surface 27 defined by four outer edges **28*a*, 28*b*, 28*c*, 28*d* and having a centrally positioned hole 29. Hole 29 is coaxial with axis 11. Each side wall has an upper edge 30, a lower edge 32 and two side edges 34 and 36. Edges 30 and 32 are substantially the same length as edges 28*a*–28*d*. Upper edges 30 of side walls 20–26 attach to respective edges 28*a*–28*d* of wall 18. Respective side edges 34 and 36 of side walls 20–26 are attached to each other, thereby, forming an open box like structure. Each side wall has an outer surface 39. Outer surfaces 39 of side walls 20, 22, 24 and 26 form a side surface. A plane containing upper surface 27 is perpendicular to axis 11. Outer surfaces 39 of side walls 20–26 are positioned transverse the upper surface 27. The lower edges 32 of walls 20–26 define a square contained in a plane 40 perpendicular to axis 11**.

The second section 14 includes converging walls 42, 44, 46 and 48. Each converging wall has an upper edge 50, lower edge 52, side edges 54 and 56 and an outer surface 58. Respective side edges of walls 42–48 are attached to each other forming a frusto pyramid shaped shell structure 59 with a first end 60 defined by edge 52 and a second smaller end 62 defined by edges 50. Respective edges 52 of end 60 attach to edges 32 of walls 20–26. Outer surfaces 58 of walls 42–48 face toward plane 40.

The second section 14 also includes diverging walls 64, 66, 68 and 70. Each diverging wall has an upper edge 72, a lower edge 74, side edges 76 and 78 and an outer surface 80. Respective side edges 76 and 78 of walls 64–70 are attached to each other forming a substantially frusto pyramid shaped shell structure 81 with a first end 82 defined by edges 72 and a second smaller end 84 defined by edges 74. Second end 84 forms a hole 85 coaxial with axis 11 and having the same diameter as hole 29. Ends 62 and 82 are the same size, and their respective edges are attached to each other. Frusto pyramid structure 81 passes through an interior space 90 of frusto pyramid structure 59 and frusto pyramid structure 81 passes through plane 40. End 84 of frusto pyramid structure 81 is positioned below plane 40, end 60 of frusto pyramid structure 59 is contained within plane 40 and ends 62 and 82 are positioned above plane 40.

Preferably, respective converging walls 42–48 and diverging walls 64–70 are spaced apart an angle $\theta$, such as 90 degrees. Further, respective converging walls 42–48 and diverging walls 64–70 should be spaced an angle $\theta$, such as 45 degrees from the plane 40.

As can be seen from FIGS. 1–3, plane 40 divides the second section 14 into two parts 100 and 102. The first part 100 is defined by walls 42, 44, 46 and 48, and an upper portion 103 of walls 64, 66, 68 and 70 which are positioned above plane 40. The first part 100 forms a recess 104 positioned above plane 40. The first part 100 also includes two edges 106 and 108 which are contained in plane 40. Edge 106 is defined by respective wall edges 52 and edge 108 is defined by portions of walls 64, 66, 68 and 70 that intercept plane 40. Although it is preferable to have recess 104 defined by first part 100, the first part 100 can also be flat and completely contained in plane 40.

Second part 102 extends downwardly and is defined by lower portions of walls 64, 66, 68 and 70, which are positioned below plane 40. Second part 102 also includes edge 108 and an edge 110 which is defined by respective diverging wall edges 74. Preferably, except for edge 108, all portions of second part 102 should be positioned closer to axis 11 than any portion of first part 100. Further, a tapering segment 112 of second part 102 is positioned below any portion of first part 100. Segment 112 has two ends, an upper end 114 closer to plane 40 and a lower end 116 which has a smaller geometric diameter than end 114. Segment 112 extends the longitudinal axis 11 and its geometric diameter continuously tapers from end 114 to 116. In most cases, the segment 112 will correspond with the second part 102. However, in some cases, second part 102 may not taper over its entire length.

The tube 16, which is open ended and hollow, has two ends, an upper end 120 and a lower end 122, and is received by holes 29 and 85. End 20 is flush with upper surface 27 of wall 18 and end 122 extends below the second section 14. Hole 29 is disposed directly above end 122 and end 122 is flush with upper surface 27. The outer diameter of tube 16 is approximately equal to the diameter of holes 29 and 85.

The first and second sections 12 and 14 form a hollow cavity 150 therebetween, gussets 160 are positioned within cavity 150 and attach to appropriate walls of both the first section 12 and the second section 14, and increase the strength of the plug 10 to compressive forces. Further, for additional strength preferably all of the elements of the plug 10 are made from metal and the respective parts are welded to each other.

Figure 4:
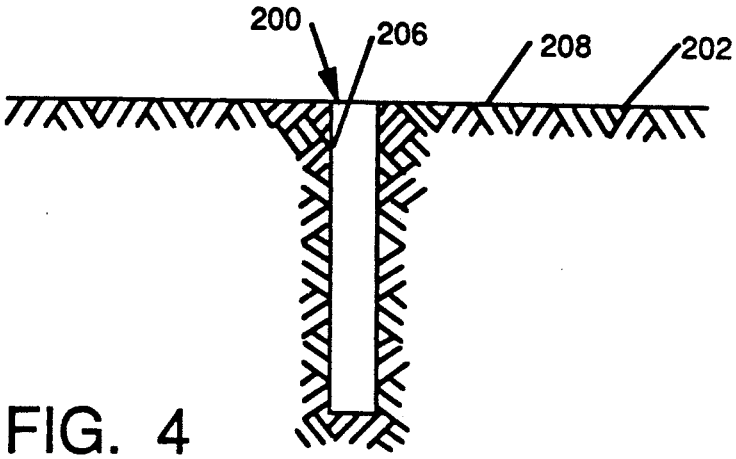
FIG. 4 shows a section of uncompacted soil having a bore hole therein.

The following is a description of the use of the plug 10. First, as shown in FIG. 4, bore hole 200 is dug in uncompacted soil 202. The diameter of the bore hole wall 206 is slightly larger than the outer diameter of tube 16. The bore hole 200 should extend at least several feet below end 122 of tube 16.

Figure 5A:
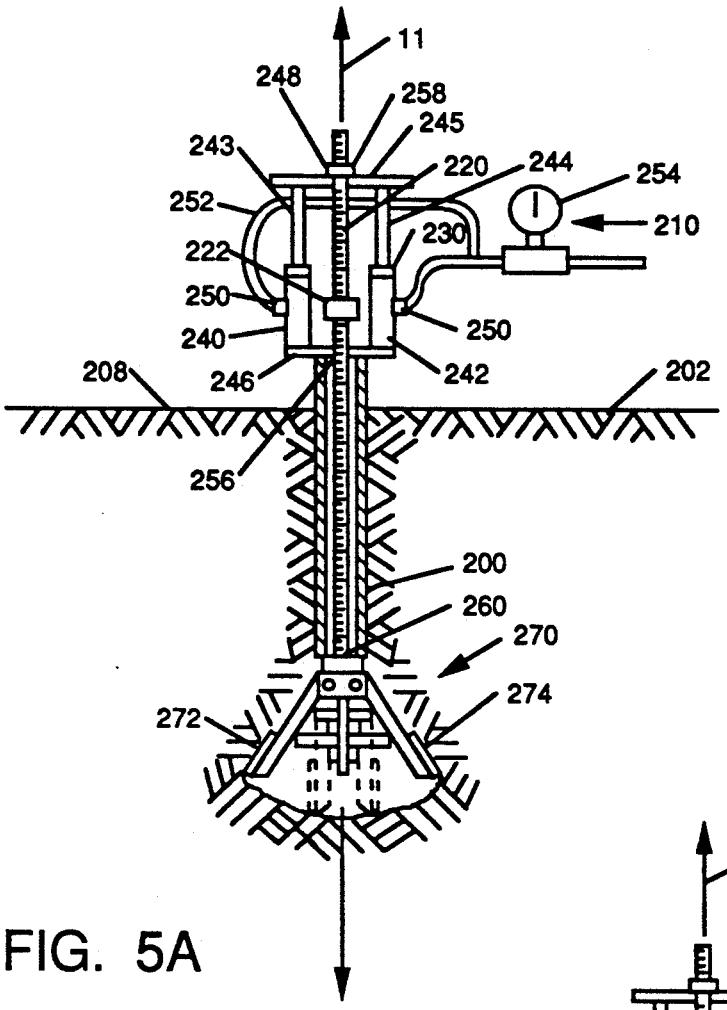
FIG. 5A is a side view, partially in section, of an anchoring device prior to being set in the soil by an anchoring device.
Figure 5B:
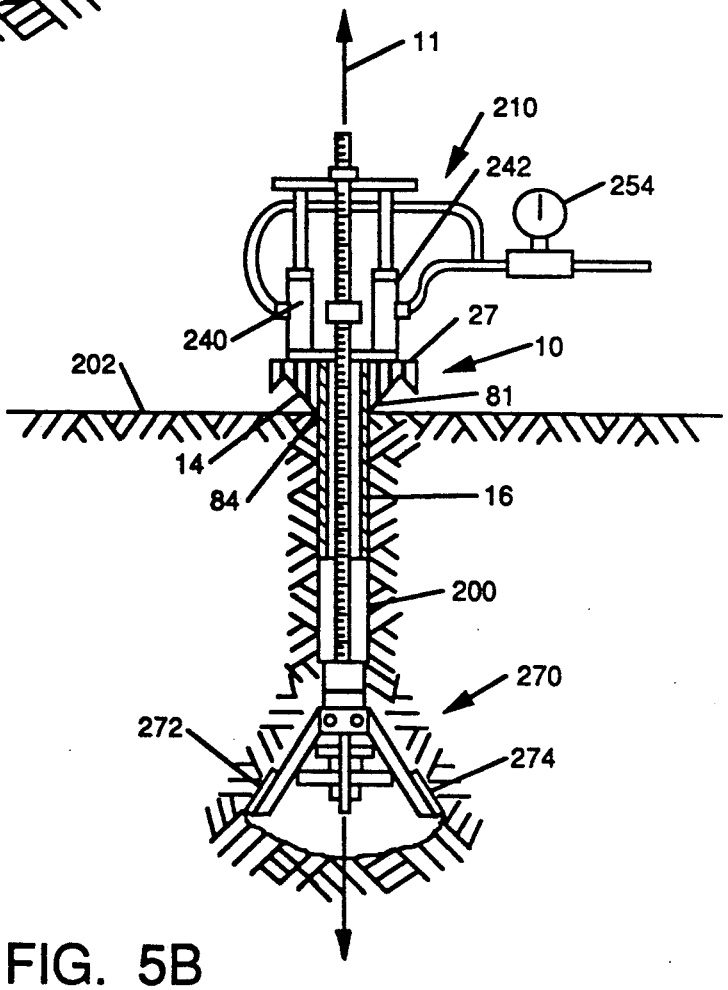
FIG. 5B shows a side view, partially in section, of the bearing pier of FIG. 5A, with the anchoring device set in the soil.

Second, as shown in FIG. 5A, an anchoring device is placed in the hole and installed as is well known in the art, then as shown in FIG. 5B, end 122 of tube 16 is placed in bore hole 200 with end 84 of frusto pyramid 81 resting on an upper surface 208 of the uncompacted soil 202. Then, the anchoring device or extendable hydraulic tool assembly 210, such as that disclosed in U.S. Pat. No. 4,974,997, which is hereby incorporated by reference, engages with the plug 10.

The anchor device 210 includes a threaded rod 220 that extends along axis 11 and passes through the tube 16. The rod also extends above and below the plug 10. The threaded rod can include a coupling 222 used to connect two shorter segments of threaded rod together. A hydraulic actuating arrangement 230 is positioned directly above the upper surface 27 of plug 10 and includes two spaced apart hydraulic motive means 240 and 242 each having pistons 243 moveable within a cylinder 244. The piston 243 has a piston arm extending out of the cylinder. Movement of each piston causes the associated piston arm to extend away from or retract into its associated cylinder. An upper piston arm bearing plate 245 secures to the extended ends of the piston arms and a cylinder bearing plate 246 secures to a base of the cylinders. Bearing plates 245 and 246 are parallel to each other. A retaining nut 248 is threadably received by the rod 222 and abuts against an upper surface of bearing plate 245 to prevent upward vertical movement of bearing plate 245. The hydraulic cylinders 240 and 242 each include nipples or entry means 250 and are connected to a flexible hydraulic hose 252. This enables the cylinder 244 to be charged with hydraulic fluid that causes the piston arm to extend outwardly from the cylinder. A change of hydraulic fluid pressure on the cylinder changes the distance between the bearing plates. Hose 252 connects to a pressure gauge 254. Hydraulic fluid is contained within the cylinders 240, 242 and hydraulic hose 252. A first bearing plate opening 256 is disposed in the cylinder bearing plate 246 midway between the cylinder and a second bearing plate opening 258 is disposed on the piston arm bearing plate 245 midway between the piston arms. The first and second openings align with each other for passage of the rods therethrough. A lower end 260 of threaded rod 220 attaches to the anchor pivot plate assembly 270 that includes restraining means or bottom side plates 272 and 274. Side plates 272 and 274 are adapted to engage with portions of the bore hole wall 206, such as shown in FIG. 5B.

Figure 6:
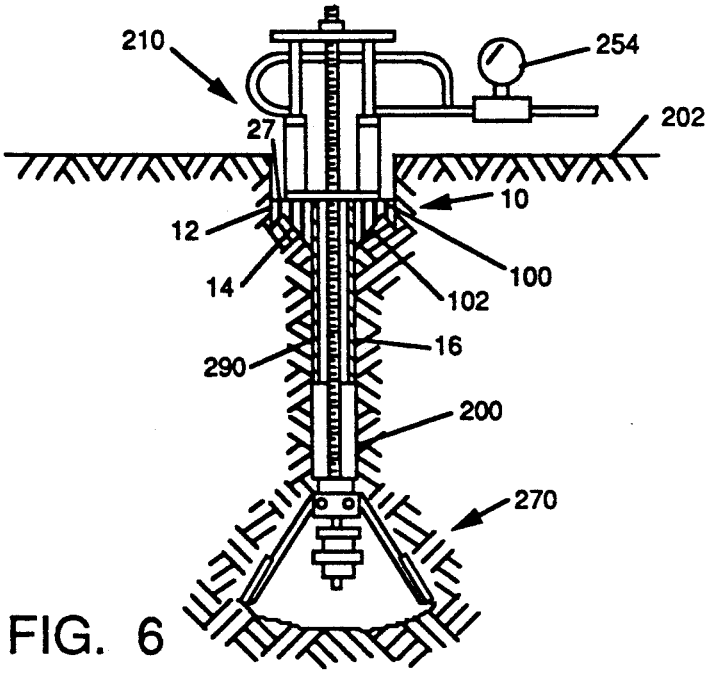
FIG. 6 shows a side view, partially in section, of the bearing pier of FIG. 5A installed in the soil by the anchoring device.

Prior to placing the tube 16 of plug 10 in the hole, the hydraulic motive means 240, 242 are actuated by pressurizing the hydraulic fluid. This causes the pistons 243 to extend upwardly, which in turn continually forces side plates 272, 274 outwardly and forms cutter arm sections in the bore hole wall 206, which is well known. Afterwards, the portion of the anchoring device 210 positioned above the soil 202 is removed and the plug is placed on the soil with end 84 resting on the soil. The second portion of the anchoring device 210 is reattached with bearing plate 246 resting on plug upper surface 27. Again, the hydraulic motor means are actuated causing bearing plate 246 to bear against upper surface of plug 10. This in turn forces the plug 10 into the uncompacted soil 202 as shown in FIG. 6 and causes compaction and consolidation of the soil therebelow. The hydraulic motive means 240 and 242 are actuated until the proper reading is obtained on the pressure gauge 254 to indicate proper compaction and consolidation of the soil positioned below the second surface 14 of plug 10. Preferably, the fluid pressure is applied to the cylinders in increments. This has been found to increase the bearing capacity of the soil. The reading on the gauge 254 corresponds to the bearing capacity of the soil 202. Accordingly, once the gauge reaches an appropriate reading, the hydraulic cylinders can be deactivated. In this manner, the bearing strength of the compacted and consolidated soil 290 can easily be determined. The corresponding gauge values are determined by test data and can be developed for any type of soil.

The portion of the diverging surfaces 64, 66, 68 and 70 positioned below plane 40, i.e. second part 102 of section 14, enable the soil 202 to be compacted radially outwardly thus increasing the bearing load capacity of the soil. The first part 100 and second section 14, prevents the soil 202 from failing upon compaction and consolidation. Specifically, the recess 104 prevents the soil from failing due to frictional failure. Preferably, the plug upper surface 27 is forced below the soil upper surface 208, thereby forming a compaction hole 290 in the soil.

Figure 7:
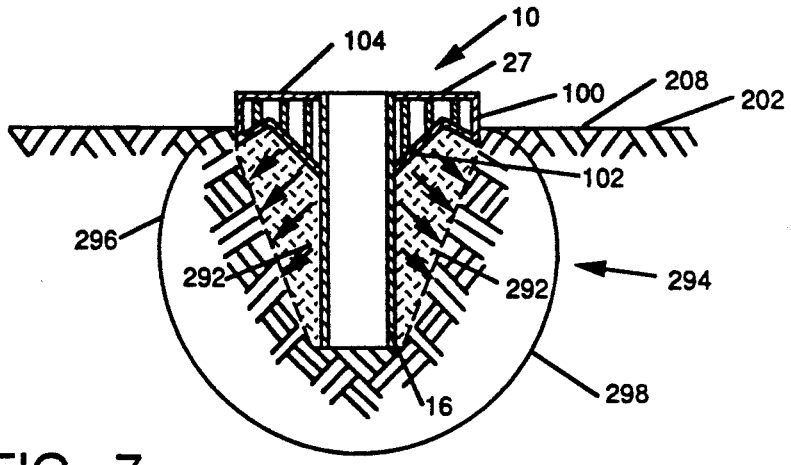
FIG. 7 shows the zones of influence in soil for the plug partially installed in the soil.

FIG. 7 shows the plug 10 partially set in the soil 202. The setting action causes the plug 10 to generate compaction, consolidation and positioning of the shear plane of the bearing soil strata as indicated by the arrows 292, which are in the lateral and vertical direction, to consolidate the surrounding media zone 294 as defined by shear lines 296 and 298.

Figure 8:
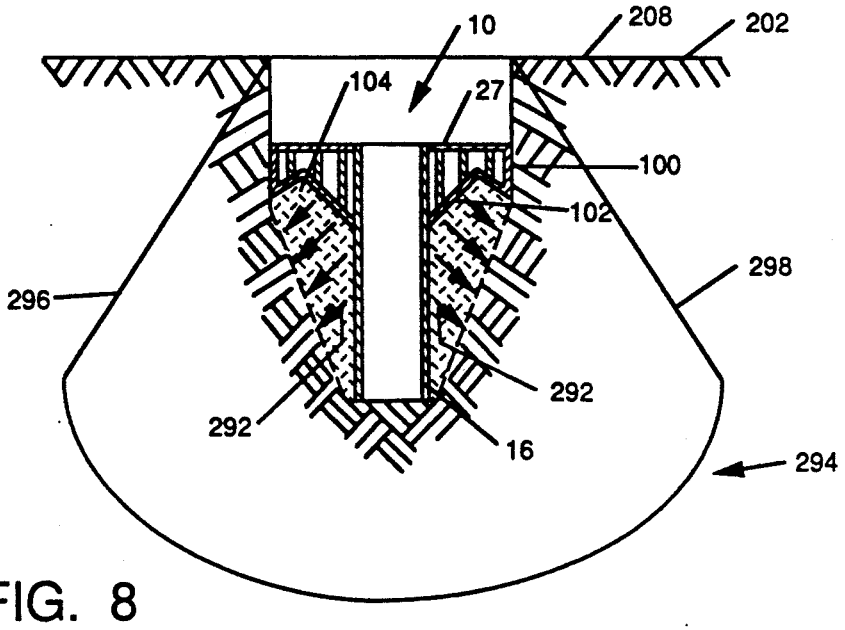
FIG. 8 shows the zones of influence in soil for the bearing pier foundation completely installed in the soil.

FIG. 8 shows the plug 10 completely set in the soil. Shear lines 296 and 298 extend radially outward from the plug and aid in increasing the load-bearing capacity of the soil. The shear plane increases as the plug 10 is set deeper in the soil.

Figure 9:
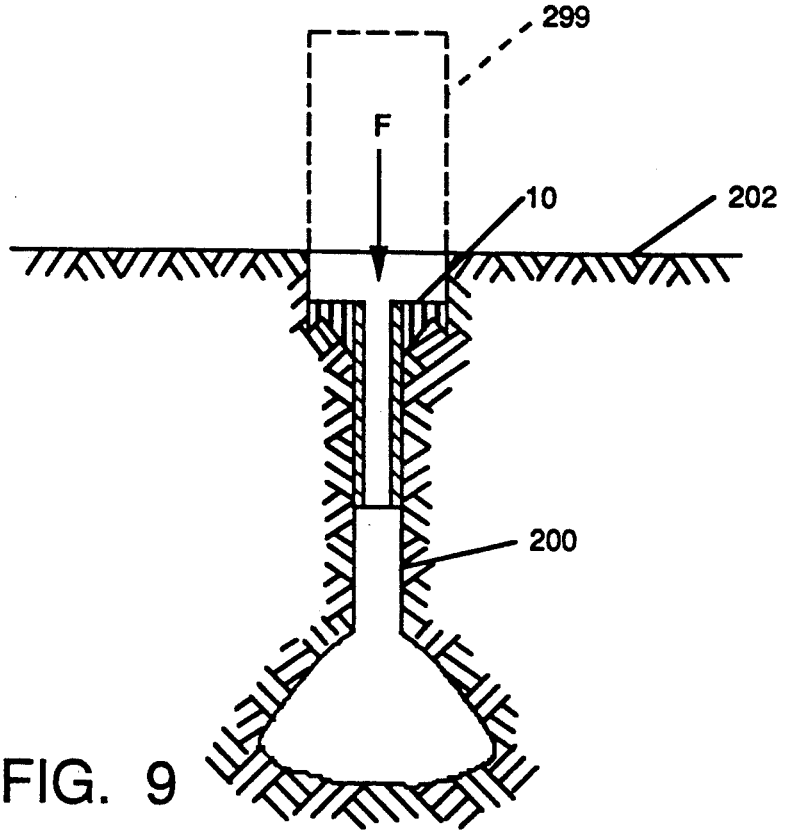
FIG. 9 shows a cross-sectional view of the bearing pier foundation of FIG. 6 with the anchoring device removed.
Figure 10:
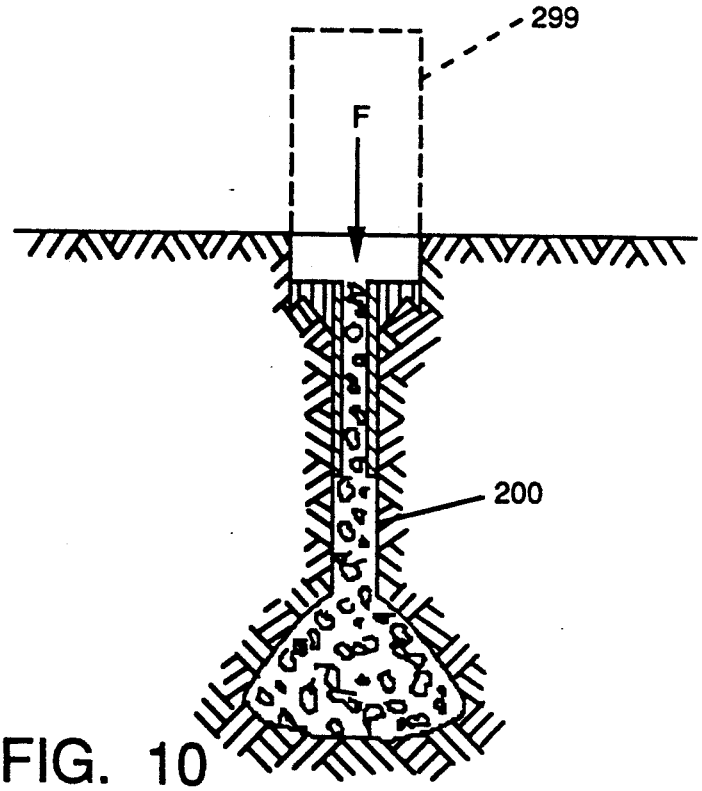
FIG. 10 shows a cross-sectional view of the bearing pier foundation of FIG. 9 with the void filled with concrete.

Next, as shown in FIG. 9, the anchoring device 210 is disengaged from the plug 10 and removed from the bore hole 200. The plug 10 can act as a spread foundation and structures 299 can be attached thereto and the forces F exerted by the structure can be supported by the stronger compacted soil therebeneath. Alternatively, concrete can be pored into the hole 290 as shown in FIG. 10 and filling the void of the plug tube 16 and the bore hole 200 either partially or completely. This adds further strength to the foundation and creates a combination spread foundation and Gow caisson pile.

Figure 11:
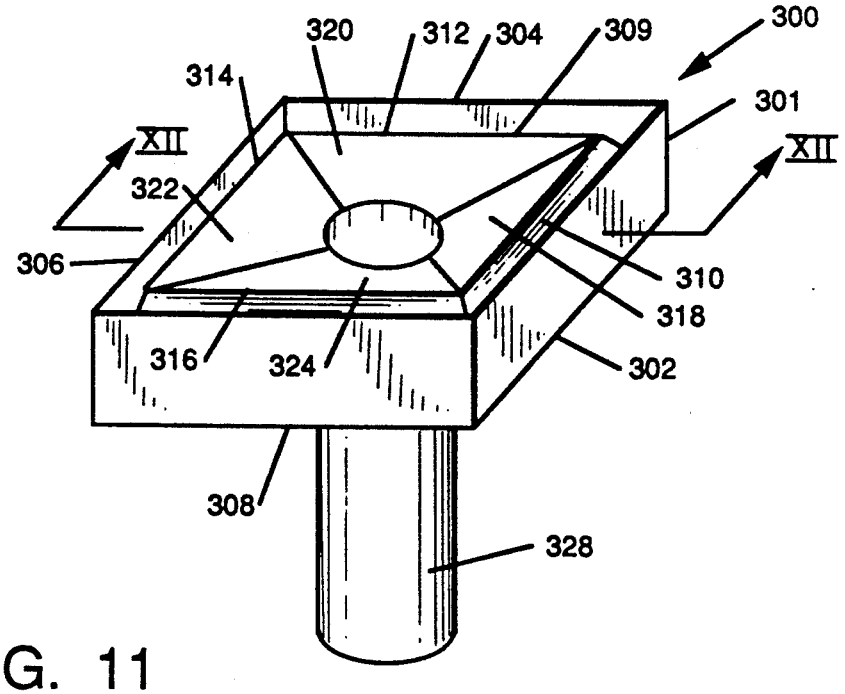
FIG. 11 shows a top perspective view of a sheath for the bearing pier foundation shown in FIG. 1 in accordance with the present invention.
Figure 12:
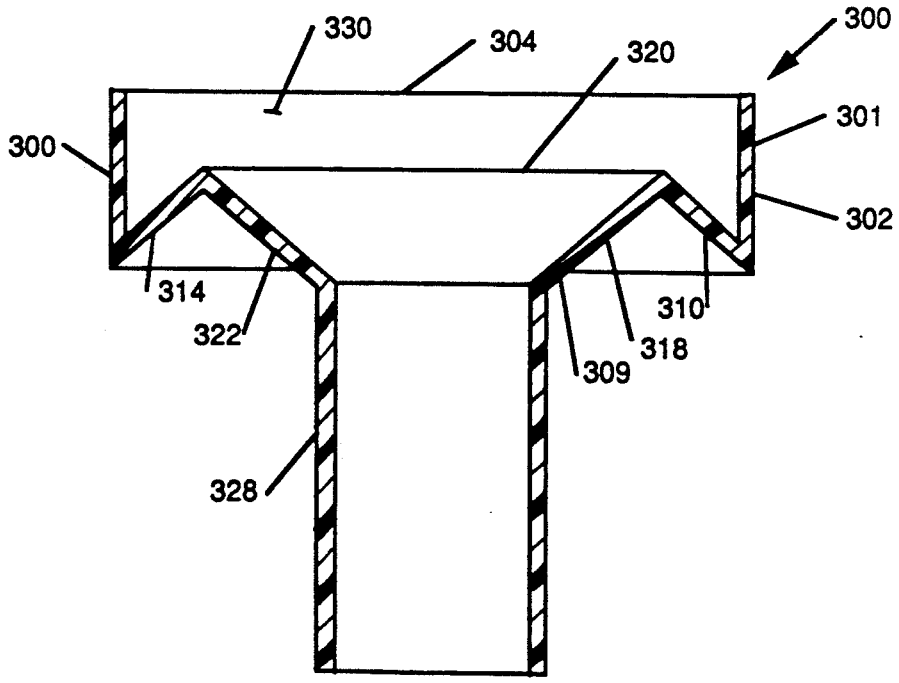
FIG. 12 is a section taken along lines XII—XII in FIG. 11.

FIGS. 11 and 12 show a further embodiment of the invention. Specifically, FIGS. 11 and 12 show a sheath 300 for receiving the plug 10. The sheath 300 is substantially geometrically similar but larger than the plug 10. The sheath 300 includes an open topped first section 301 having four side walls 302, 304, 306 and 308 integrally attached to each other at their respective ends. The sheath 300 further includes a second section 309 having converging walls 310, 312, 314 and 316, and diverging walls 318, 320, 322 and 324. Respective ends of walls 310–316 attach to walls 302–308; and respective edges of walls 310–316 attach to walls 318–324. An open ended tube 328 extends below walls 318–324 and has one end attached thereto.

The inner surfaces of the sheath correspond to outer surfaces of the plug 10. Specifically, inner surfaces of walls 302–304 conform to the side surface shape formed by walls 20–26 of the plug 10. Inner surfaces of walls 310–316 form a frusto pyramid 59 formed by walls 42–48 of the plug 10. Inner surfaces of walls 318–324 form a frusto pyramid conforming to frusto pyramid 81 formed by walls 64–70 of the plug 10. Inner surface of tube 328 conforms to the outer surface of tube 16 extending below frusto pyramid 81 of plug 10. A cavity 330 is defined by the inner surfaces of the first section 301, the second section 309 and the tube 328. The sheath is preferably made of plastic sheet and can be vacuumed formed.

Figure 13:
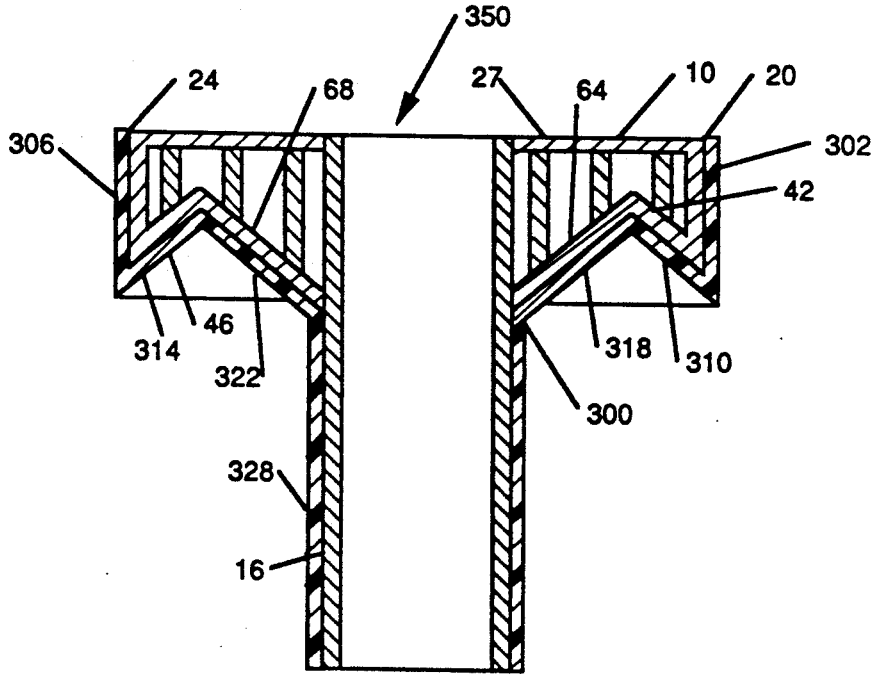
FIG. 13 is a cross-sectional view of the bearing pier foundation shown in FIG. 1 received by the sheath shown in FIG. 11.
Figure 14:
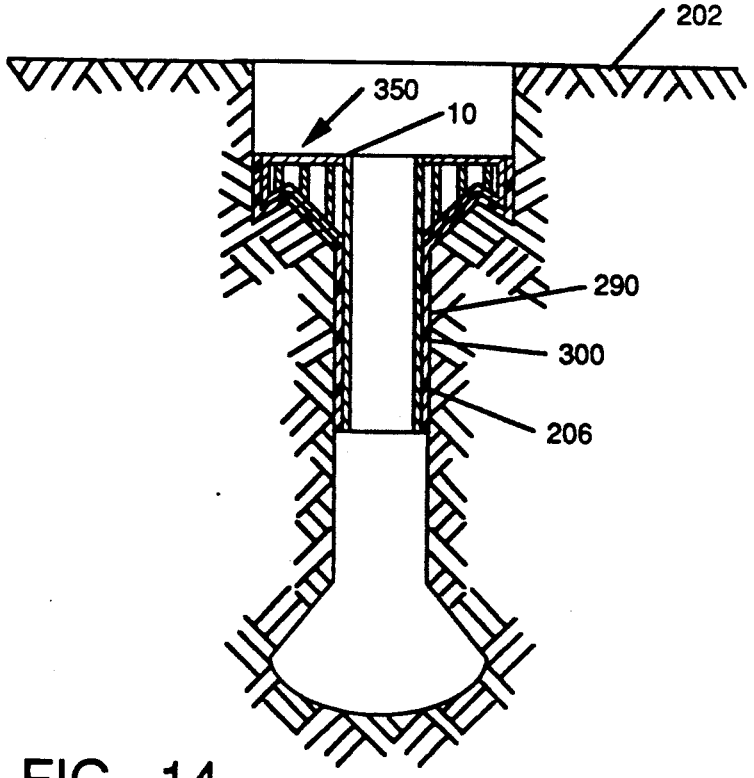
FIG. 14 is a cross-sectional view of the bearing pier foundation and sheath shown in FIG. 13 installed in the soil.
Figure 15:
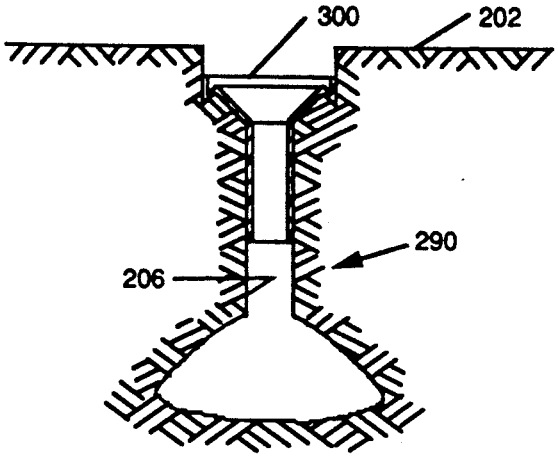
FIG. 15 is a cross-sectional view of the sheath shown in FIG. 14 installed in the soil after the bearing pier foundation is removed leaving a void.
Figure 16:
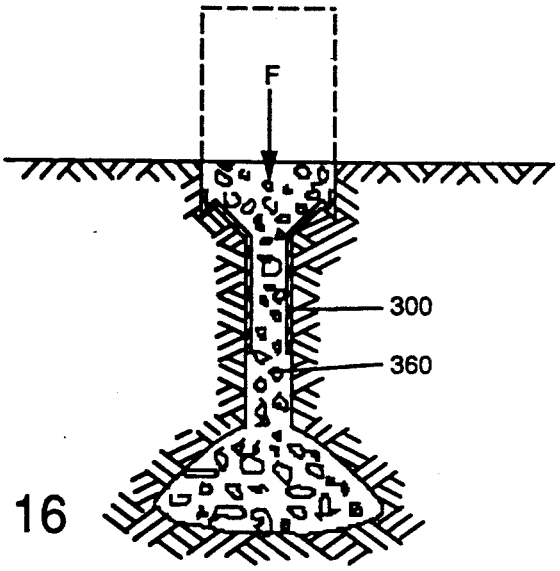
FIG. 16 is a cross-sectional view of the sheath and the void filled with concrete.

As shown in FIG. 13, the plug 10 is received within cavity 330 of sheath 300 forming a sheath/plug arrangement 350. Specifically, outer surfaces of plug walls 20–26, 42–48 and 64–70, and tube wall 16, abut inner surfaces of sheath walls 302–306, 310–312, 318–324 and the inner surface of tube 26, respectively. The sheath/-plug arrangement 350 is installed in the same manner as previously discussed for plug 10. However, as shown in FIG. 14, after anchoring device 210 is disengaged, and, as shown in FIG. 15, the plug 10 is also removed from the compressed bore hole 290 area. Thus, the plug 10 can be reused. Finally, as shown in FIG. 16, the hole 206 and cavity 330 of sheath 300, which form a void, are filled with concrete 360, resulting in a foundation.

A plug made in accordance with the present invention need not be limited to the shape shown in FIGS. 1–3, but can also include other geometric shapes for the first section, second section and tube, such as those shown in FIGS. 17–22. However, the plugs must include a first section and second section where the second section includes the limitation of parts 100 and 102.

Figure 17:
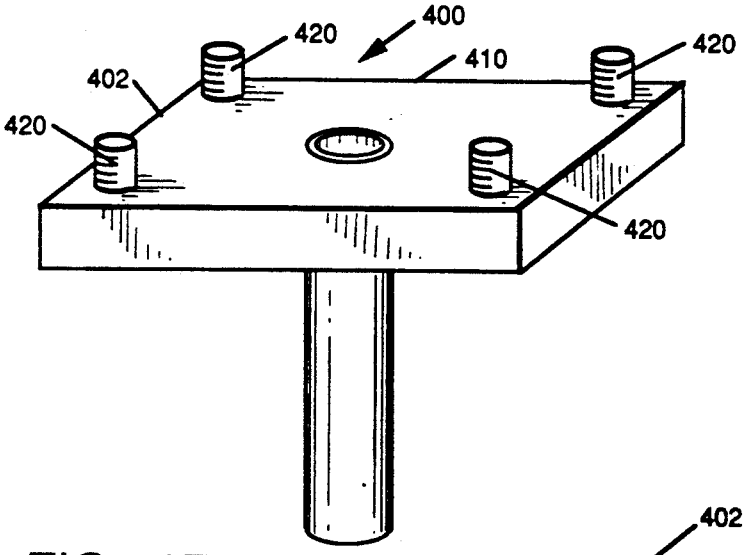
FIG. 17 is a top perspective view of a rectangularly shaped bearing pier foundation in accordance with the present invention.
Figure 18:
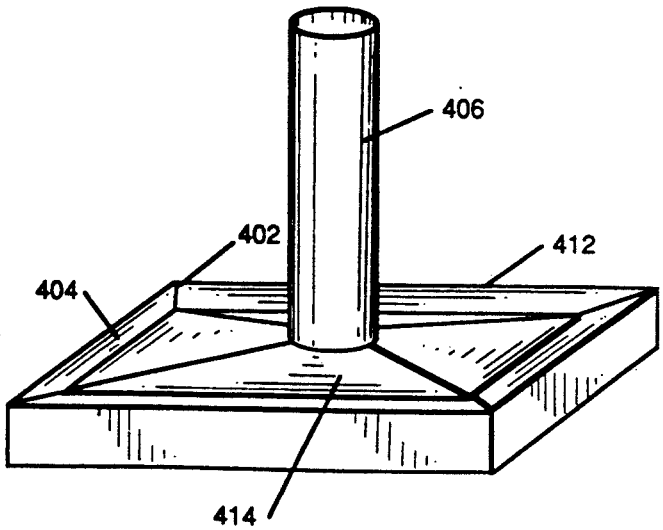
FIG. 18 is a bottom perspective view of the bearing pier foundation of FIG. 17.

Specifically, FIGS. 17 and 18 show a plug 400 having a first section 402, a second section 404 and a tube 406, all attached to each other. The first section 402 includes a substantially rectangular shaped upper surface 410. The second section 404 includes two frusto pyramids 412 and 414 having rectangular shaped ends. Four threaded shafts 420 extend upwardly from the upper surface of the first section 402. Structural brackets, which are well known in the art, fasten to the shafts 420. Ports or columns can then attach to the brackets.

Figure 19:
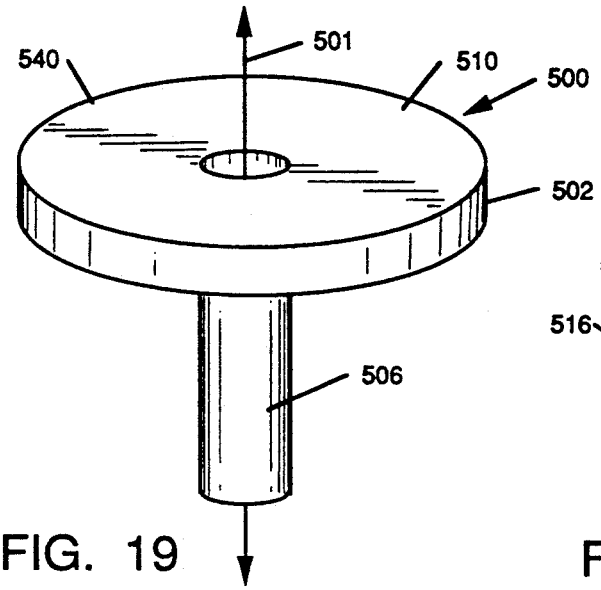
FIG. 19 is a top perspective view of a circular shaped bearing pier foundation in accordance with the present invention.
Figure 20:
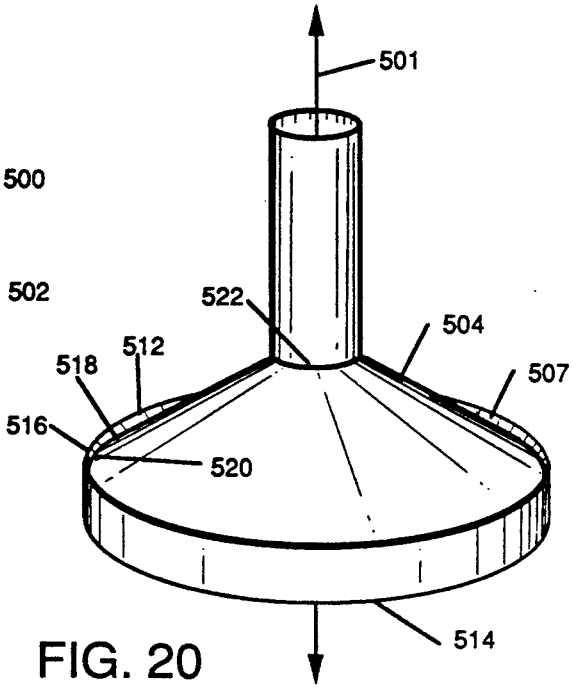
FIG. 20 is a bottom perspective view of the bearing pier foundation of FIG. 19.

FIGS. 19 and 20 show a plug 500 extending along an axis 501 having a first section 502, a second section 504 and a tube 506 coaxial with the axis 501, all attached to each other. The first section includes a substantially circular shaped upper surface 510. The second section includes two frusto shaped cone shaped surfaces 512 and 514 having circular shaped ends. The tube extends below cone surfaces 512 and 514. Frusto cone shaped surface 512 has a first end 516 larger than a second end 518 and a frusto cone shaped surface 514 has a third end 520 that is larger than a fourth end 522. The second end 518 and the third end 520 are the same size and are attached to each other. The first end 516 attaches to the first section 502 and the fourth end 522 positioned below the first end 516. The ends 518 and 520 are positioned above a plane passing through the cones and perpendicular to axis 501. End 522 is positioned below the plane and end 516 is contained within the plane. The first section includes a circular upper surface 540 having a hole passing therethrough.

Figure 21:
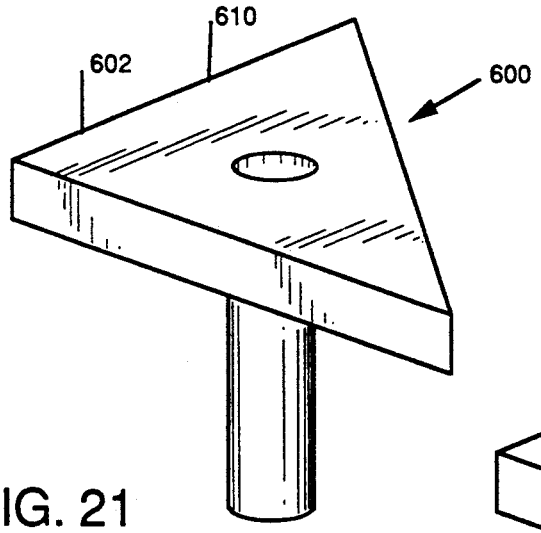
FIG. 21 is a top perspective view of a triangular bearing pier foundation in accordance with the present invention.
Figure 22:
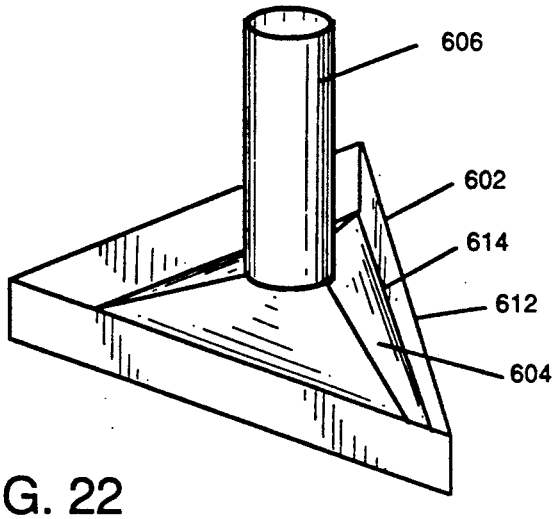
FIG. 22 is a bottom perspective view of the bearing pier foundation of FIG. 21.

FIGS. 21 and 22 show a plug 600 having a first section 602, a second section 604 and a tube 606, all attached to each other. The first section 606 includes a substantially flat triangular shaped upper surface 610. The second section 604 includes two frusto pyramids 612 and 614 having triangular shaped ends.

Figure 23A:
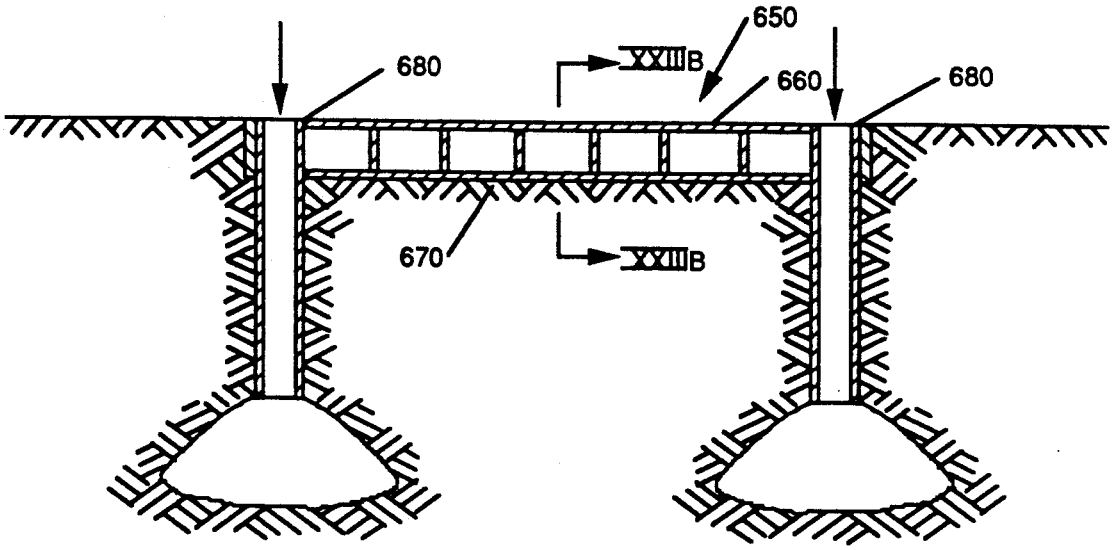
FIG. 23A is a side view, partially in section, of another embodiment of an installed bearing pier made in accordance with the present invention.
Figure 23B:
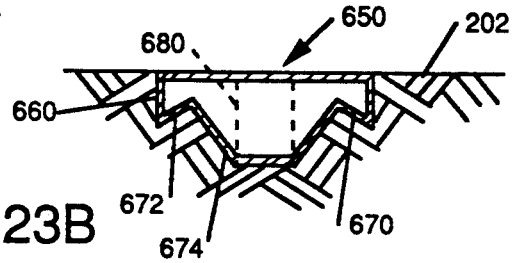
FIG. 23B is a cross-sectional of FIG. 23A.

FIG. 23 shows an installed plug 650 similar to plug 101, except it has two tubes. Plug 650 includes a first section 660, a second section 670 having a first part 672 and 674, and two tubes 680. Separate anchoring means pass through respective tubes 660. A complete footing of a foundation can be installed in this manner.

Figure 24:
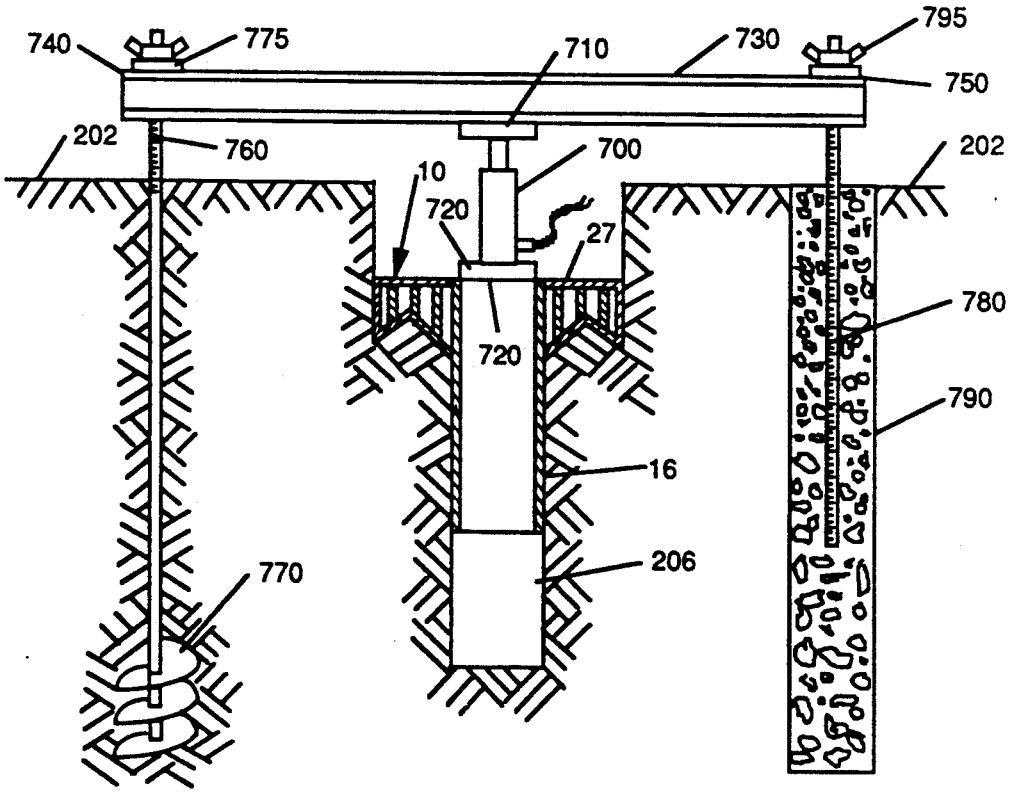
FIG. 24 is a side view, partially in section, of another embodiment for installing the bearing pier shown in FIG. 1.

FIG. 24 shows an alternative installation of the plug 10. Specifically, a hydraulic actuating arrangement 700 is positioned above plug 10 between an upper bearing plate 710 and a lower bearing plate 720. Bearing plate 720 rests on the upper surface 27 of plug 10. Elongated I-beams 730, of which only one is shown, rest on bearing plate 710. Each I-beam 730 has opposite ends 740 and 750. A threaded rod 760 passes between I-beams 730. One end of rod 760 attaches to a screw-type anchor 770, which is well known in the art. The other end of rod 760 has a wing nut/plate arrangement 775 threadably attached thereto and abutting upper surfaces of the I-beams 730. Likewise, a threaded rod 780 passes between I-beams 730 near ends 750.. An end of threaded rod 780 is embedded in a concrete-type anchor 790 and the other end has a wing nut/plate arrangement 795 threadably attached thereto and abutting upper surfaces of I-beams 730. Either type of anchors 770 or 790 can be used in place of the pivot plate assembly 270 of the anchor 210.

In operation, the lower end of the plug 10 is placed in a pre-dug bore hole and then the above-described anchoring system is set up, as shown. Next, the hydraulic actuating arrangement 700 is pressurized as previously discussed and the plug 10 is forced into the soil 202, thereby compacting and consolidating the soil below plug 10. After proper compaction and consolidation of the soil is obtained, the I-beams 730 are removed and a structure can be placed directly on the plug 10 or the plug 10 can first be filled with concrete, as previously discussed. Anchors 770 or 790 can either be left in the soil or removed.

The above installation methods of plug 10 require two persons and the plug 10 can be installed quickly, say in the order of an hour. Further, the plug can be reuseable if used with a sheath. Thus, the above-described invention results in increased soil strength without the large cost of heavy machinery or piles.

Although the preferred embodiments were shown installed in soil, the plugs can also be installed in other media such as rock and can be installed sideways or upwardly, such as in a mine tunnel.

Having described the presently preferred embodiments of my invention, it is to be understood that it may otherwise be embodied within the scope of the appended claims.

I claim:

1. A bearing pier foundation for compacting soil, comprising a plug extending along a longitudinal axis having a first section and a second section, said first section adapted to receive a pushing force for pushing the plug into the soil and said second section adapted to rest on the soil to be compacted, a plane, which is perpendicular to the longitudinal axis, passes through said second section, said second section comprising a first part and a second part, said first part having an inner edge and an outer edge intersecting the plane, said outer edge of said first part attached to said first section and positioned further away from the longitudinal axis than said inner edge of said first part and said first part forms a recess positioned above the plane, and said second part having an outer edge attached to said first part inner edge, said second part extending downwardly from the plane, said second part having a tapering segment extending along the longitudinal axis and having an upper end and a lower end, said upper end positioned closer to the plane and having a larger geometric diameter than said lower end, and said segment continuously tapers from said upper end to said lower end.

2. A bearing pier foundation as claimed in claim 1 wherein the lower end of said segment is positioned below the first part.

3. A bearing pier foundation as claimed in claim 1 wherein said plug further comprises a tube attached to said second section and coaxial with and extending along the longitudinal axis, a lower end of said tube positioned below the plane and said second section.

4. A bearing pier foundation as claimed in claim 3 wherein said first section includes a flat upper surface with a hole coaxial with said longitudinal axis, said hole disposed directly above said tube lower end.

5. A bearing pier foundation as claimed in claim 4 wherein said tube passes through said hole of the upper surface of the first section, said tube having an upper end that is flush with the upper surface.

6. A bearing pier foundation as claimed in claim 1 wherein the second section includes a first frusto pyramid shaped surface having a first end that is larger than a second end and a second frusto pyramid shaped surface having a third end that is larger than a fourth end, said second end and said third end are substantially the same size whereby said second end attaches to said third end, said first end attaches to said first section, and said fourth end is positioned below said first end, and said second end and third end are positioned above the plane and said fourth end is positioned below the plane.

7. A bearing pier foundation as claimed in claim 6 wherein said first section includes a polygon shaped upper surface having a hole passing therethrough, which is coaxial with said longitudinal axis and said first frusto pyramid shaped surface includes four converging sides and said second frusto pyramid shaped surfaces include four diverging sides, and said plug further comprising an open ended tube attached to said second section and coaxial with the longitudinal axis, said tube having a lower end extending below said fourth end of said second pyramid shaped structure.

8. A bearing pier foundation as claimed in claim 7 wherein said upper surface is rectangular shaped.

9. A bearing pier foundation as claimed in claim 7 wherein said upper surface is triangular shaped.

10. A bearing pier foundation of claim 1 wherein the second section includes a first frusto cone shaped surface having a first end larger than a second end and a second frusto cone shaped surface having a third end that is larger than a fourth end, said second end and said third end are the same size whereby said second end attaches to said third end, said first end attaches to said first section, and said fourth end is positioned below said first end, and said second end and said third end are positioned above the plane and said fourth end is positioned below the plane.

11. A bearing pier foundation as claimed in claim 10 wherein said first section includes a circular shaped upper surface having a hole, which is coaxial with the longitudinal axis, passing therethrough, said plug further comprising a tube attached to said second section and coaxial with the longitudinal axis, said tube having a lower end extending below said second cone shaped surface.

12. A sheath for a bearing pier foundation for compacting soil wherein the bearing pier foundation includes a plug extending along a longitudinal axis having a first section having a side surface and a second section, said first section adapted to receive a pushing force for pushing the plug into the soil and said second section adapted to rest on the soil to be compacted, a plane, which is perpendicular to the longitudinal axis passes through said second section, said second section having an outer surface formed by a first part and a second part, said first part having an inner edge and an outer edge intersecting the plane, said outer edge of said first part attached to said first section and positioned further away from the longitudinal axis than said inner edge of said first part and said first part forms a recess positioned above the plane, and said second part having an outer edge attached to said first part inner edge, said second part extending downwardly from the plane and having a tapering segment extending along the longitudinal axis, said tapering segment having an upper end and a lower end, said upper end positioned closer to the plane and having a larger geometric diameter than said lower end and said segment continuously tapers along the longitudinal axis from said upper end to said lower end, said sheath comprising:

a first section having an inner surface conforming to the side surface of the plug first section, said sheath first section including a recess portion, and an integral second section having an inner surface conforming to the outer surface of its second section of the plug, said inner surfaces of said sheath forming a cavity adapted to receive said plug.

13. A sheath for a bearing pier foundation as claimed in claim 12 wherein the plug further includes a tube attached to the second section and coaxial with and extending along the longitudinal axis, a lower end of the tube positioned below the plane and the second part, said sheath further comprising an integral open ended tube attached to and extending below said sheath second section, said tube having an inner diameter approximately equal to the outer diameter of the plug tube.

14. A sheath as claimed in claim 12 wherein said sheath is made from a plastic material.

15. In combination, a bearing pier foundation for compacting soil and a sheath, said bearing pier foundation comprising: a plug extending along a longitudinal axis having a first section and a second section, said first section adapted to have a side surface receive a pushing force for pushing the plug into the soil and said second section adapted to rest on the soil to be compacted, a plane, which is perpendicular to the longitudinal axis passes through said second section, said second section having an outer surface formed by a first part and a second part, said first part having an inner edge and an outer edge intersecting the plane, said outer edge of said first part attached to said first section and positioned further away from the longitudinal axis than said inner edge of said first part, and said second surface having an outer edge attached to said first part inner edge and said first part forms a recess above the plane, said second part extending downwardly from the plane, said second part having a tapering segment extending along the longitudinal axis and having an upper end and a lower end, said upper end positioned closer to the plane and having a larger geometric diameter than said lower end and the geometric diameter of said segment continuously tapers along the longitudinal axis from said upper end to said lower end; and said sheath comprising a first section having an inner surface conforming to the side surface of the plug first section and a second section having an inner surface conforming to the outer surface of the second section of the plug, said inner surfaces of said sheath forming a cavity adapted to receive said plug, wherein said plug is received by the cavity of said sheath and the side surface of said plug first section and said outer surface of said plug second section contact said inner surface of said sheath.

16. In combination, an extendable hydraulic setting tool and a bearing pier foundation for compacting soil, said bearing pier foundation comprising: a plug extending along a longitudinal axis having a first section and a second section, said first section adapted to receive a pushing force for pushing the plug into the soil and said second section adapted to rest on the soil to be compacted, a plane, which is perpendicular to the longitudinal axis passes through said second section, said second section comprising a first part and a second part, said first part having an inner edge and an outer edge intersecting the plane, said outer edge of said first part attached to said first section and positioned further away from the longitudinal axis than said inner edge of said first part, and said first part forms a recess positioned above the plane, and said second part having an outer edge attached to said first part inner edge, said second part extending downwardly from the plane, said second part having a tapering segment extending along the longitudinal axis and having an upper end and a lower end, said upper end positioned closer to the plane and having a larger geometric diameter than said lower end, and the geometric diameter of said segment continuously tapers along the longitudinal axis from said upper end to said lower end; and said extendable hydraulic setting tool comprising: means for applying a compressing force to said first section of said plug for forcing said plug second section into the soil and an anchor.

17. A combination as claimed in claim 16 wherein said plug includes a hole passing therethrough and an upper surface in said first section, said extendable hydraulic setting tool assembly further comprising: side-by-side spaced apart hydraulic motive means, each of said motive means comprising a piston movable within a cylinder with said piston having a piston arm extending out of said cylinder, movement of each piston causing the associated piston arm to extend away from or retract into its associated cylinder, a cylinder bearing plate secured to the base of said cylinders, an upper piston arm bearing plate secured to the extended ends of said piston arms, entry means in each of said cylinders for charging hydraulic fluid thereto, entry of said fluid causing said piston arms to extend outwardly from said cylinders, said bearing plates being parallel to each other, a first bearing plate opening disposed in said cylinder bearing plate midway between said cylinders, a second bearing plate opening disposed on said piston arm bearing plate midway between said piston arms, said first and said second openings aligned with each other for the passage of a rod therethrough, said assembly adapted so that a change in hydraulic fluid pressure in said cylinders changes the distance between said bearing plates, and said anchor having a rod extending therefrom, said rod extending through said aligned openings, and restraining means on said rod for restraining movement of one of said bearing plates, the other of said bearing plates adapted for bearing on said upper surface of said plug to set said device in the soil wherein said rod passes through the hole of said plug.

18. A method of making a soil foundation utilizing a bearing pier foundation for compacting soil, comprising a plug extending along a longitudinal axis having a first section and a second section, said first section adapted to receive a pushing force for pushing the plug into the soil and said second section adapted to rest on the soil to be compacted, a plane, which is perpendicular to the longitudinal axis passes through said second section, said second section comprising a first part and a second part, said first part having an inner edge and an outer edge intersecting the plane, said outer edge of said first part attached to said first section and positioned further away from the longitudinal axis than said inner edge of said first part and said first part forms a recess positioned above the plane, and said second part having an outer edge attached to said first part inner edge, said second part extending downwardly from the plane, said second part having a tapering segment extending along the longitudinal axis and having an upper end and a lower end, said upper end positioned closer to the plane and having a larger geometric diameter than said lower end, and said segment continuously tapers along the longitudinal axis from said upper end to said lower end, the method comprising the steps of:

a) placing the second section of the plug on a surface of uncompressed soil;

b) applying a compressive force to the first section; and c) forcing said plug into the soil, thereby compressing and consolidating the soil in said recess and directly below said plug.

19. A method of making a soil foundation as claimed in claim 18 further comprises filling said plug with concrete after said soil is compressed and consolidated.

20. A method of making a soil foundation as claimed in claim 18 further comprising first placing a sheath over said plug before compressing the soil, removing said plug from the compressed and consolidated soil and leaving said sheath in the soil and filling the sheath with concrete.

21. A method of making a soil foundation as claimed in claim 18 further comprising digging a hole into the soil, placing said plug over said hole, placing an anchor into said hole, engaging the anchor with the soil, utilizing said anchor with a setting tool for applying the compressive force to the first section; and activating the setting tool to apply the compressing force to the plug first section.

22. A method of making a soil foundation as claimed in claim 18 wherein said bearing pier foundation is forced in the soil by a hydraulic setting tool having a hydraulic cylinder charged with hydraulic fluid, and a gauge for measuring hydraulic fluid pressure of the hydraulic fluid, the method further comprising measuring the fluid pressure of the hydraulic fluid while the plug is being forced into the soil.

23. A bearing pier foundation for compacting soil, comprising a plug extending along a longitudinal axis having a first section, a second section and a tube, said first section adapted to receive a pushing force for pushing the plug into the soil and said second section adapted to rest on the soil to be compacted, a plane, which is perpendicular to the longitudinal axis, passes through said second section, said second section comprising a first part and a second part, said first part having an inner edge and an outer edge intersecting the plane, said outer edge of said first part attached to said first section and positioned further away from the longitudinal axis than said inner edge of said first part and said first part forms a recess positioned above the plane, and said second part having an outer edge attached to said first part inner edge, said second part extending downwardly from the plane, said second part having a tapering segment extending along the longitudinal axis and having an upper end and a lower end, said upper end positioned closer to the plane and having a larger geometric diameter than said lower end, and said segment continuously tapers from said upper end to said lower end and said tube attached to said second section and coaxial with and extending along the longitudinal axis, a lower end of said tube positioned below the plane and said second section.

24. A bearing pier foundation as claimed in claim 23 wherein said first section includes a flat upper surface with a hole coaxial with said longitudinal axis, said hole disposed directly above said tube lower end.

25. A bearing pier foundation as claimed in claim 24 wherein said tube passes through said hole of the upper surface of the first section, said tube having an upper end that is flush with the upper surface.

26. A bearing pier foundation for compacting soil, comprising a plug extending along a longitudinal axis having a first section and a second section, said first section adapted to receive a pushing force for pushing the plug into the soil and said second section adapted to rest on the soil to be compacted, a plane, which is perpendicular to the longitudinal axis, passes a first frusto pyramid shaped surface having a first end that is larger than a second end and a second frusto pyramid shaped surface having a third end that is larger than a fourth end, said second end and said third end are substantially the same size whereby said second end attaches to said third end, said first end attaches to said first section, and said fourth end is positioned below said first end, and said second end and third end are positioned above the plane and said fourth end is positioned below the plane.

27. A bearing pier foundation as claimed in claim 26 wherein said first section includes a polygon shaped upper surface having a hole passing therethrough, which is coaxial with said longitudinal axis and said first frusto pyramid shaped surface includes four converging sides and said second frusto pyramid shaped surfaces include four diverging sides, and said plug further comprising an open ended tube attached to said second section and coaxial with the longitudinal axis, said tube having a lower end extending below said fourth end of said second pyramid shaped structure.

28. A bearing pier foundation as claimed in claim 27 wherein said upper surface is rectangular shaped.

29. A bearing pier foundation as claimed in claim 27 wherein said upper surface is triangular shaped.

30. A bearing pier foundation for compacting soil, comprising a plug extending along a longitudinal axis having a first section and a second section, said first section adapted to receive a pushing force for pushing the plug into the soil and said second section adapted to rest on the soil to be compacted, a plane, which is perpendicular to the longitudinal axis, passes through said second section, said second section comprising a first frusto cone shaped surface having a first end larger than a second end and a second frusto cone shaped surface having a third end that is larger than a fourth end, said second end and said third end are the same size whereby said second end attaches to said third end, said first end attaches to said first section, and said fourth end is positioned below said first end, and said second end and said third end are positioned above the plane and said fourth end is positioned below the plane.

31. A bearing pier foundation as claimed in claim 30 wherein said first section includes a circular shaped upper surface having a hole, which is coaxial with the longitudinal axis, passing therethrough, said plug further comprising a tube attached to said second section and coaxial with the longitudinal axis, said tube having a lower end extending below said second cone shaped surface.

32. In combination, an extendable hydraulic setting tool and a bearing pier foundation for compacting soil, said bearing pier foundation comprising: a plug extending along a longitudinal axis having a first section, a second section and a hole passing therethrough, said first section having an upper surface adapted to receive a pushing force for pushing the plug into the soil and said second section adapted to rest on the soil to be compacted, a plane, which is perpendicular to the longitudinal axis passes through said second section, said second section comprising a first part and a second part, said first part having an inner edge and an outer edge intersecting the plane, said outer edge of said first part attached to said first section and positioned further away from the longitudinal axis than said inner edge of said first part, and said second part having an outer edge attached to said first part inner edge, said second part extending downwardly from the plane, said second part having a tapering segment extending along the longitudinal axis and having an upper end and a lower end, said upper end positioned closer to the plane and having a larger geometric diameter than said lower end, and the geometric diameter of said segment continuously tapers along the longitudinal axis from said upper end to said lower end; and said extendable hydraulic setting tool comprising: spaced apart hydraulic motive means, each of said motive means comprising a piston movable within a cylinder with said piston having a piston arm extending out of said cylinder, movement of said piston causing the associated piston arm to extend away from or retract into its associated cylinder, a cylinder bearing plate secured to the base of said cylinders, an upper piston arm bearing plate secured to the extended ends of said piston arms, entry means in each of said cylinders for charging hydraulic fluid thereto, entry of said fluid causing said piston arms to extend outwardly from said cylinders, said bearing plates being parallel to each other, a first bearing plate opening disposed in said cylinder bearing plate midway between said cylinders, a second bearing plate opening disposed on said piston arm bearing plate midway between said piston arms, said first and said second openings aligned with each other for the passage of a rod therethrough, said assembly adapted so that a change in hydraulic fluid pressure in said cylinders changes the distance between said bearing plates, and an anchor having a rod extending therefrom, said rod extending through said aligned openings, and restraining means on said rod for restraining movement of one of said bearing plates, the other of said bearing plates adapted for bearing on said upper surface of said first section of said plug to set said device in the soil wherein said rod passes through the hole of said plug.

33. A method of making a soil foundation utilizing a bearing pier foundation for compacting soil, comprising a plug extending along a longitudinal axis having a first section and a second section, said first section adapted to receive a pushing force for pushing the plug into the soil and said second section adapted to rest on the soil to be compacted, a plane, which is perpendicular to the longitudinal axis passes through said second section, said second section comprising a first part and a second part, said first part having an inner edge and an outer edge intersecting the plane, said outer edge of said first part attached to said first section and positioned further away from the longitudinal axis than said inner edge of said first part and said first part forms a recess positioned above the plane, and said second part having an outer edge attached to said first part inner edge, said second part extending downwardly from the plane, said second part having a tapering segment extending along the longitudinal axis and having an upper end and a lower end, said upper end positioned closer to the plane and having a larger geometric diameter than said lower end, and said segment continuously tapers along the longitudinal axis from said upper end to said lower end, the method comprising the steps of:

a) placing the second section of the plug on a surface of uncompressed soil;
b) applying a compressive force to the first section;
c) forcing said plug into the soil, thereby compressing and consolidating the soil in said recess and directly below said plug; and
d) filling said plug with concrete after said soil is compressed and consolidated.

34. A method of making a soil foundation utilizing a bearing pier foundation for compacting soil, comprising a plug extending along a longitudinal axis having a first section and a second section, said first section adapted to receive a pushing force for pushing the plug into the soil and said second section adapted to rest on the soil to be compacted, a plane, which is perpendicular to the longitudinal axis passes through said second section, said second section comprising a first part and a second part, said first part having an inner edge and an outer edge intersecting the plane, said outer edge of said first part attached to said first section and positioned further away from the longitudinal axis than said inner edge of said first part and said first part forms a recess positioned above the plane, and said second part having an outer edge attached to said first part inner edge, said second part extending downwardly from the plane, said second part having a tapering segment extending along the longitudinal axis and having an upper end and a lower end, said upper end positioned closer to the plane and having a larger geometric diameter than said lower end, and said segment continuously tapers along the longitudinal axis from said upper end to said lower end, the method comprising the steps of:

a) first placing a sheath over said plug;
b) placing the second section of the plug on a surface of uncompressed soil;
c) applying a compressive force to the first section;
d) forcing said plug into the soil, thereby compressing and consolidating the soil in said recess and directly below said plug;
e) removing said plug from the compressed and consolidated soil;
f) leaving said sheath in the soil; and g) filling the sheath with concrete.

35. A method of making a soil foundation utilizing a bearing pier foundation for compacting soil, comprising a plug extending along a longitudinal axis having a first section and a second section, said first section adapted to receive a pushing force for pushing the plug into the soil and said second section adapted to rest on the soil to be compacted, a plane, which is perpendicular to the longitudinal axis passes through said second section, said second section comprising a first part and a second part, said first part having an inner edge and an outer edge intersecting the plane, said outer edge of said first part attached to said first section and positioned further away from the longitudinal axis than said inner edge of said first part and said first part forms a recess positioned above the plane, and said second part having an outer edge attached to said first part inner edge, said second part extending downwardly from the plane, said second part having a tapering segment extending along the longitudinal axis and having an upper end and a lower end, said upper end positioned closer to the plane and having a larger geometric diameter than said lower end, and said segment continuously tapers along the longitudinal axis from said upper end to said lower end, the method comprising the steps of:

a) digging a hole into the soil;

b) placing said plug over said hole;

c) placing the second section of the plug on a surface of uncompressed soil;

d) placing an anchor into said hole;

e) engaging the anchor with the soil;

f) utilizing said anchor with a setting tool for applying a compressive force to the first section;

g) activating the setting tool to apply the compressing force to the plug first section; and h) forcing said plug into the soil, thereby compressing and consolidating the soil in said recess and directly below said plug.

36. A method of making a soil foundation utilizing a bearing pier foundation for compacting soil, comprising a plug extending along a longitudinal axis having a first section and a second section, said first section adapted to receive a pushing force for pushing the plug into the soil and said second section adapted to rest on the soil to be compacted, a plane, which is perpendicular to the longitudinal axis passes through said second section, said second section comprising a first part and a second part, said first part having an inner edge and an outer edge intersecting the plane, said outer edge of said first part attached to said first section and positioned further away from the longitudinal axis than said inner edge of said first part and said first part forms a recess positioned above the plane, and said second part having an outer edge attached to said first part inner edge, said second part extending downwardly from the plane, said second part having a tapering segment extending along the longitudinal axis and having an upper end and a lower end, said upper end positioned closer to the plane and having a larger geometric diameter than said lower end, and said segment continuously tapers along the longitudinal axis from said upper end to said lower end, wherein said bearing pier foundation is forced in the soil by a hydraulic setting tool having a hydraulic cylinder charged with hydraulic fluid and a gauge for measuring hydraulic fluid pressure of the hydraulic fluid, the method comprising the steps of:

a) placing the second section of the plug on a surface of uncompressed soil;

b) applying a compressive force to the first section;

c) forcing said plug into the soil, thereby compressing and consolidating the soil in said recess and directly below said plug; and d) measuring the fluid pressure of the hydraulic fluid while the plug is being forced into the soil.

* * * * *

UNITED STATES PATENT AND TRADEMARK OFFICE

CERTIFICATE OF CORRECTION

PATENT NO. : 5,234,290
DATED : August 10, 1993
INVENTOR(S) : James S. Collins

It is certified that error appears in the above-indentified patent and that said Letters Patent is hereby corrected as shown below:

Column 1, line 55, "our" should read --my--.

Column 1, line 57, "our" should read --my--.

Column 2, line 60, "have" should read --having--.

Column 4, line 27, after "cross-sectional" insert --view--.

Column 7, lines 26-27, "14, prevents" should read --14 prevents--.

Column 9, line 26, "750.." should read --750.--.

Signed and Sealed this

Thirty-first Day of May, 1994

Bruce Lehman

*Attest:*

BRUCE LEHMAN

*Attesting Officer*

*Commissioner of Patents and Trademarks*